US007603061B2

(12) United States Patent
Ebara et al.

(10) Patent No.: US 7,603,061 B2
(45) Date of Patent: Oct. 13, 2009

(54) IMAGE FORMING APPARATUS

(75) Inventors: Joh Ebara, Kamakura (JP); Handa Seiichi, Tokyo-to (JP); Matsuda Yuji, Inagi (JP); Kouji Amanai, Yokohama (JP); Yasuhisa Ehara, Kamakura (JP); Kobayashi Kazuhiko, Tokyo-to (JP); Toshiyuki Uchida, Kawasaki (JP); Noriaki Funamoto, Machida (JP); Sugiyama Keisuke, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 240 days.

(21) Appl. No.: 11/711,713

(22) Filed: Feb. 28, 2007

(65) Prior Publication Data

US 2007/0212109 A1 Sep. 13, 2007

(30) Foreign Application Priority Data

Feb. 28, 2006 (JP) ..... 2006-052501

(51) Int. Cl.
*G03G 15/00* (2006.01)

(52) U.S. Cl. ..... 399/167

(58) Field of Classification Search ..... 399/167
See application file for complete search history.

(56) References Cited

U.S. PATENT DOCUMENTS 5,950,052 A * 9/1999 Nomura et al. ..... 399/167
5,983,066 A * 11/1999 Abe et al. ..... 399/394
2005/0019066 A1* 1/2005 Ito et al. ..... 399/302

FOREIGN PATENT DOCUMENTS

| | | |
|---|---|---|
| JP | 57-157275 | 9/1982 |
| JP | 57-204574 | 12/1982 |
| JP | 02-072377 | 3/1990 |
| JP | 03-260664 | 11/1991 |
| JP | 11-212426 | 8/1999 |
| JP | 2002-148900 | 5/2002 |
| JP | 2002-341725 | 11/2002 |
| JP | 2004-199044 | 7/2004 |
| JP | 2005-346002 | 12/2005 |

OTHER PUBLICATIONS

Translation of Oba, 2002341725.*
European Search report for corresponding application.

* cited by examiner

*Primary Examiner*—David M Gray
*Assistant Examiner*—Joseph S Wong
(74) *Attorney, Agent, or Firm*—Harness, Dickey & Pierce, P.L.C.

(57) ABSTRACT

An image forming apparatus to form an image on a recording medium, capable of reducing deterioration of image bearer, is disclosed. In one embodiment, the image forming apparatus includes an image bearer, a driver to move the image bearer, a image forming device to form a visible image on the image bearer, a contacting member to form a nip by contacting with the image bearer, and a controller to control the driver for driving stop with a distance shifted on a surface of the image bearer from a start of driving. An amount of the shifted distance is greater than a width of the nip and is not a divisional number of a peripheral length of the image bearer.

20 Claims, 14 Drawing Sheets

N1 = 2mm
$\theta_2$ = 5.7°
$\theta_1$ = 7.0°

IMAGE FORMING APPARATUS

PRIORITY STATEMENT

The present patent application claims priority under 35 U.S.C. §119 upon Japanese patent application No. 2006-052501, filed in the Japan Patent Office on Feb. 28, 2006, the content and disclosure of which is hereby incorporated by reference herein in its entirety.

BACKGROUND

1. Field

Example embodiments generally relate to an image forming apparatus such as printers, copying machines, facsimiles, etc. capable of forming an visible image on an image bearer such as photoconductor drums, for example.

2. Discussion of the Background

Background image forming apparatuses may typically form a nip between an image bearer and a transfer belt and/or a charge roller. Such image forming apparatus may cause a problem in that the image bearer is rubbed due to the difference in moving speed between the image bearer and the contacting member (i.e., the transfer belt and charging roller) especially when the image bearer stops of rotation, resulting deterioration of the image bearer. The above-mentioned moving speed difference may generally become large just before stop of rotation of the image bearer. Therefore, stopping of the image bearer at the same stop position may accelerate deterioration of the image bearer because the same portion of the surface of the image bearer may be worn in every stop operation of the image bearer.

In attempting to solve this problem, a background image forming apparatus changing the stop position in every driving stop operation of the image bearer is proposed. Specifically, the stop position, i.e., the nip between a photoconductor endless belt serving as an image bearer and a contacting member may be controlled. In this example, acceleration of deterioration of the photoconductor endless belt caused by wearing at every stop operation of may be controlled.

However, if the stop position of an image bearer is changed by 10 degrees, for example, the image bearer may be stopped at the same position after every 36 (360/10) stop operations. This stop operation may also accelerate the deterioration of the image bearer. Further, the same portion of the image bearer may receive a maximum pressure after every 36 stop operations. Then, a wear strongly may occur in the same portion of the maximum pressure in the nip, being worn repeatedly every rotation.

This problem may occur on not only a cylindrical photoconductor drum but also an endless photoconductor belt as an image bearer.

SUMMARY

An embodiment of the present invention is directed to an image forming apparatus to form an image on a recording medium, capable of reducing deterioration of image bearer. The image forming apparatus of at least one embodiment may include an image bearer, a driver to move the image bearer, an image forming device to form a visible image on the image bearer, a contacting member to form a nip with the image bearer, and a controller to control the driver such that the image bearer is stopped at a position different from a last stop position by a given distance, wherein the amount of the given distance is greater than the width of the nip and is not a divisor of a peripheral length of the image bearer, i.e., the following equation is satisfied: D=PL/n wherein D represents the given distance, PL represents the peripheral length of the image bearer, and n is an integer which is not a divisor of the peripheral length.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of example embodiments when considered in connection with the accompanying drawings, wherein.

DETAILED DESCRIPTION OF EXAMPLE EMBODIMENTS

Figure 1:
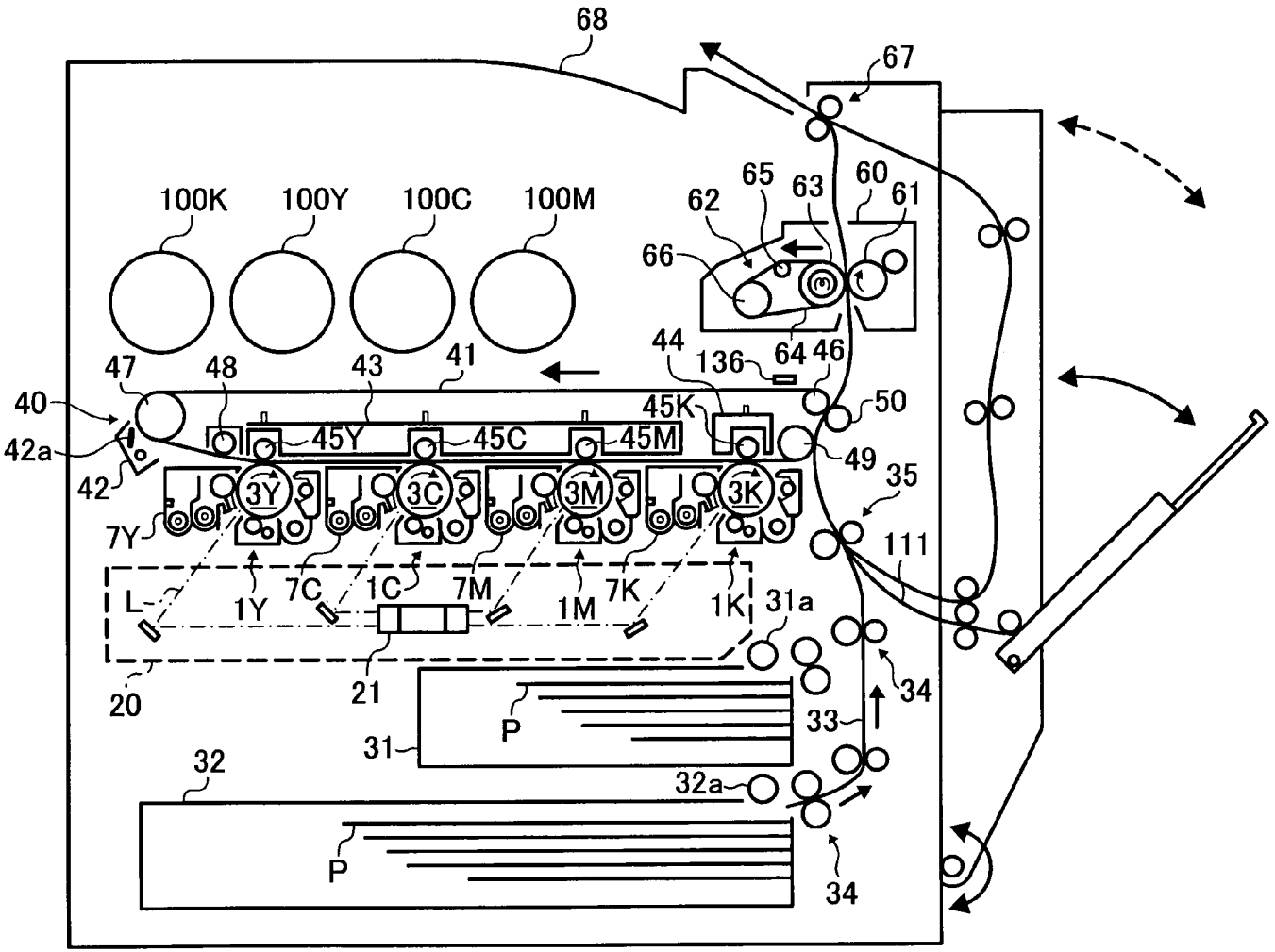
FIG. 1 is a cross-sectional diagram (according to an example embodiment of the present invention) illustrating an image forming apparatus.

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 18, an example of a first transfer nip of an image forming apparatus according to example embodiments is explained.

Figure 2:
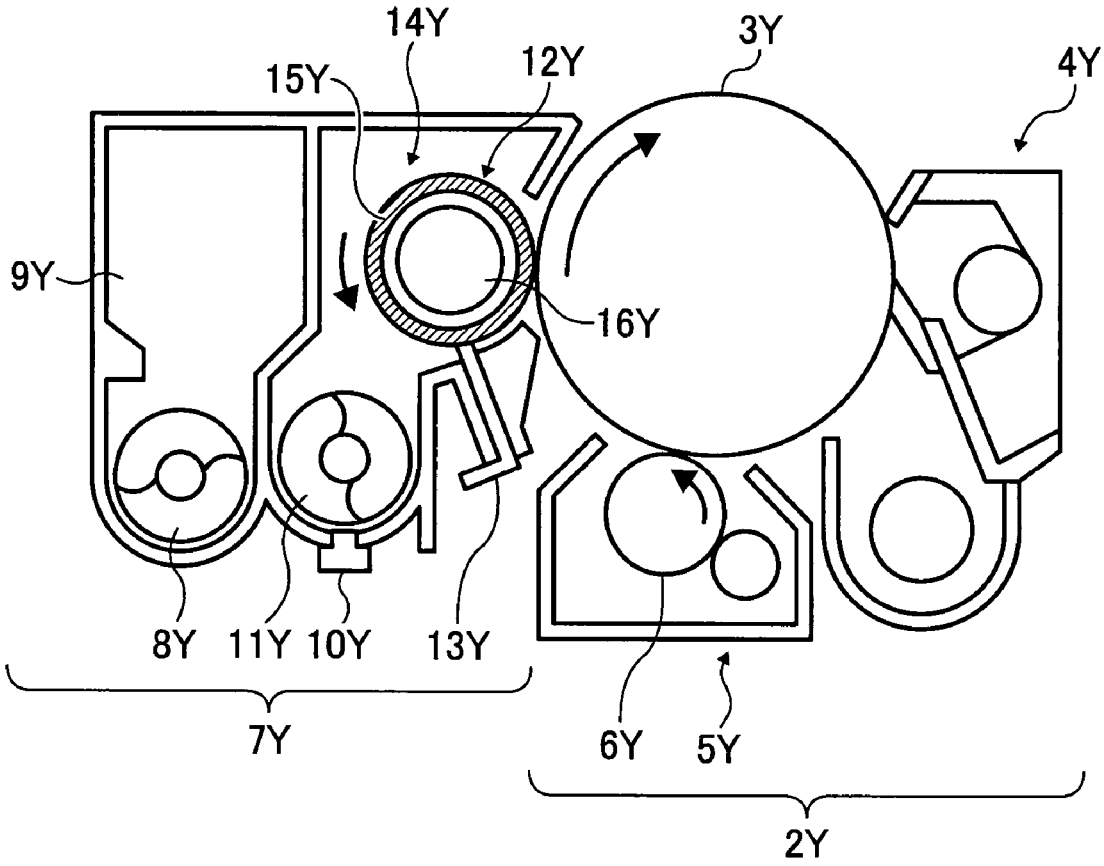
FIG. 2 is a cross-sectional diagram (according to an example embodiment of the present invention) illustrating a process unit of the image forming apparatus of FIG. 1.
Figure 3:
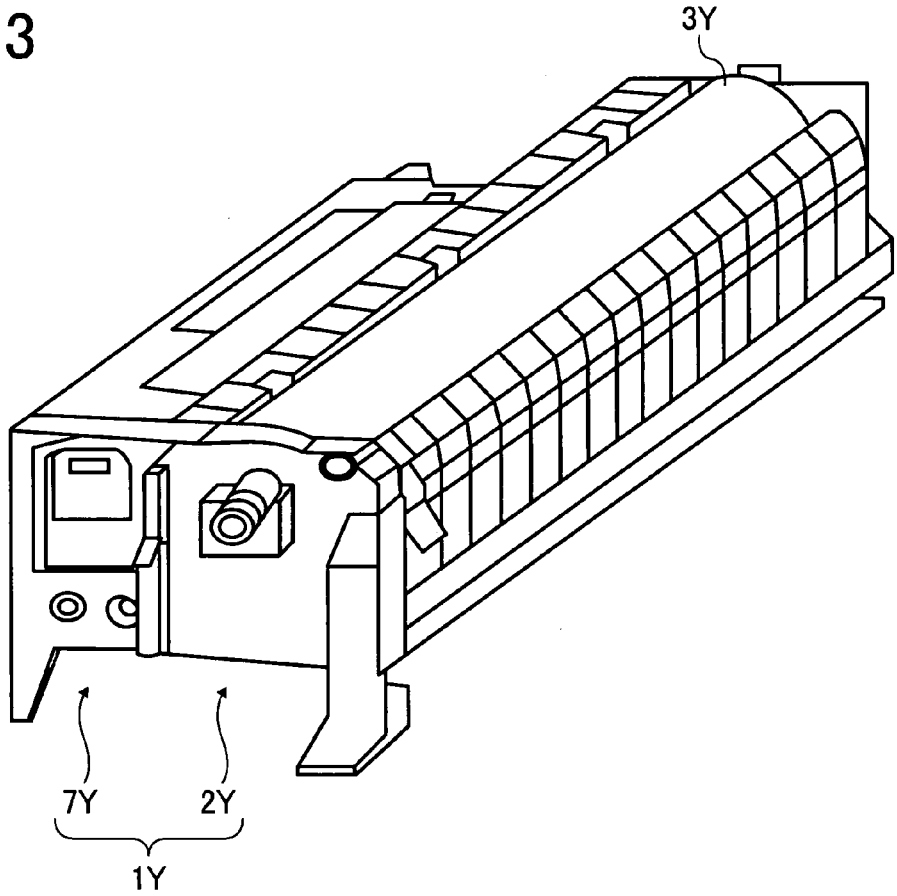
FIG. 3 is a perspective diagram (according to an example embodiment of the present invention) illustrating the process unit of the image forming apparatus of FIG. 1.
Figure 4:
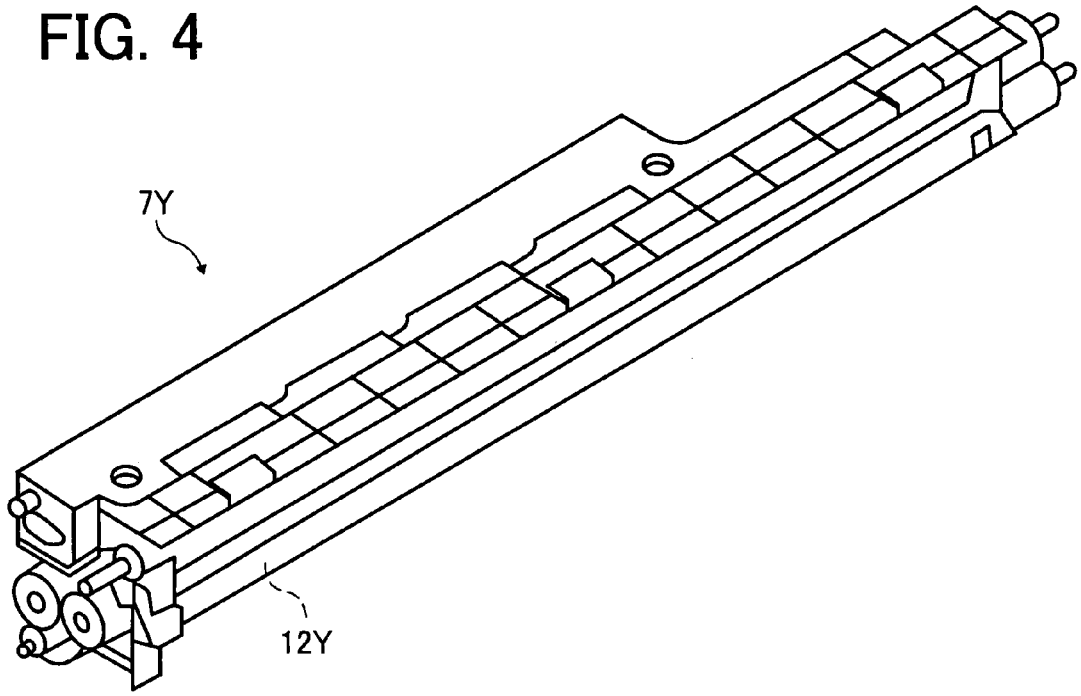
FIG. 4 is a perspective diagram (according to an example embodiment of the present invention) illustrating a developing unit of the process unit of the image forming apparatus of FIG. 1.

FIG. 1 is a cross-sectional diagram illustrating a configuration of an image forming apparatus according to example embodiments. FIG. 2 is a cross-sectional diagram illustrating a process unit of the image forming apparatus of FIG. 1. FIG. 3 is a perspective diagram illustrating the process unit of the image forming apparatus of FIG. 1. FIG. 4 is a perspective diagram illustrating a developing unit of the process unit of the image forming apparatus of FIG. 1. As shown in FIG. 1, an electrophotographic printer as an image forming apparatus includes four process units 1Y, 1C, 1M, and 1K. Notations Y, M, C, and K mean a yellow, a magenta, a cyan, and a black, respectively. The process units 1Y, 1C, 1M, and 1K have a same configuration using toner of each color as an developers to develop latent images. As shown in FIG. 2, the process unit 1Y includes a photoconductor unit 2Y and a development unit 7Y. They are united as the process unit 1Y and may be detached and attached to the main part of the electrophotographic printer. In the state where it is removed from the main part of the electrophotographic printer, the development unit 7Y may be detached and attached to the non-illustrated photoconductor unit as shown in FIG. 4.

As shown in FIG. 2, the photoconductor unit 2Y includes a photoconductor 3Y in the shape of a drum (cylinder) which is a latent image bearer and an image bearer, a drum cleaning unit 4Y, a non-illustrated neutralization unit, a charging unit 5Y, etc.

The charging unit 5Y may evenly form electrification on the surface of the photoconductor 3Y rotated clockwise by a non-illustrated driver. A charge roller 6Y rotated counterclockwise with an electrification bias applied by a non-illustrated power supply may contact with the photoconductor 3Y, so that the photoconductor 3Y may evenly charged. Instead of the charge roller 6Y, an electrification brush may be used. Another charging type may be used for an even charge, for example, a scorotron charger. A surface of the photoconductor 3Y, which is evenly charged with the charging unit 5Y, may be scanned by a laser irradiated from an optical writing unit so that an electrostatic latent image for Y may be held on the photoconductor 3Y.

The developing unit 7Y includes a first developer container 9Y including a first conveyance screw 8Y. The developing unit 7Y further include a second developer container 14Y including a toner density sensor 10Y such as a permeability sensor, a second conveyance screw 11Y, a development roll 12Y, a doctor blade 13Y, etc. These two developer containers include non-illustrated Y developers including a magnetic career and a Y toner having a minus electrostatic property. Rotating the first conveyance screw 8Y may cause the Y developers in the first developer container 9Y to move from front side to rear side. The Y developer may further move into the second developer container 14Y through a non-illustrated path across the first developer container 9Y and the second developer container 14Y.

Rotating the second conveyance screw 11Y may cause the Y developer in the second developer container 14Y to move from rear side to front side. The toner density sensor 10Y fixed to the bottom of the second developer container 14Y may detect a toner density of the Y developer. The development roll 12Y is provided in upper part parallel to the second conveyance screw 11Y. This development roll 12Y includes a development sleeve 15Y made of a non-magnetism pipe and rotated counterclockwise, and the development sleeve 15Y includes a magnet roller 16Y. A part of the Y developer conveyed by the second conveyance screw 11Y may be conveyed on the development sleeve 15Y surface by the magnetism of the magnet roller 16Y. The doctor blade 13Y may control the height of the Y developer on the development sleeve 15Y surface, which may keep a given gap with the development sleeve 15Y surface. The Y developer may be further conveyed to a region facing to the photoconductor 3Y, and Y toner may be transferred onto the electrostatic latent image on the photoconductor 3Y. Thus, a Y toner image may be formed on the photoconductor 3Y. The Y developer consumed Y toner may be returned back on the second conveyance screw 11Y with rotation of the development sleeve 15Y of the development roll 12Y. The Y developer may further conveyed into the first developer container 9Y through a non-illustrated path.

The detection result of the permeability of the Y developer by the toner density sensor 10Y may be sent by a voltage signal to a non-illustrated controller. The controller may include a random access memory (RAM) which stores data of desired toner density sensor output voltage Vtref for Y, M, C, and K. As the development unit 7Y, the Vtref for Y and the output voltage from the toner density sensor 10Y may be compared. A non-illustrated toner feed unit for Y may be driven for a time according to the comparison result. In the first developer container 9Y, a proper quantity of Y toner may be supplied to the Y developer in which a Y toner density has been reduced due to a Y toner consumption for developing. Therefore, the Y toner density of the Y developer in the second developer container 14Y may be maintained within a given range. A similar toner supply control may be carried for the developer in the process units for the other colors 1C, 1M, and 1K. Other processes in the colors C, M, and K may also be carried out similarly with Y.

The Y toner image formed on the photoconductor 3Y may be firstly transferred onto an intermediate transfer belt mentioned later. The drum cleaning unit 4Y of the photoconductor unit 2Y may remove a waste toner on the photoconductor 3Y surface after the first transfer process. The cleaned photoconductor 3Y surface may be discharged by a non-illustrated neutralization unit. The surface of the photoconductor 3Y may be initialized by this neutralization, and it may be standby for the next image formation.

An optical writing unit 20 may be provided under the process units 1Y, 1C, 1M, and 1K as shown in FIG. 1. The optical writing unit 20 may irradiate a laser light L based on picture information onto the photoconductors 3Y, 3C, 3M, and, 3K in the process units 1Y, 1C, 1M, and 1K, respectively. Thereby, the electrostatic latent images for Y, C, M, and K may be formed on the photoconductors 3Y, 3C, 3M, and 3K, respectively. In this example, the optical writing unit 20 uses a polygon mirror 21 which may rotate and reflect the laser light L emitted from the light source, and may deviate the light through two or more optical lenses and mirrors, and may irradiate the light on the photoconductors 3Y, 3C, 3M, and 3K. An LED array may be replaced with the polygon mirror type as an optical writing unit.

A first sheet cassette 31 and a second sheet cassette 32 are provided under the optical writing unit 20. Sheets P as a recording media are piled up in these sheet cassettes. A first feeding roller 31*a* and a second feeding roller 32*a* are in contact with a top sheet. Rotating the first feeding roller 31*a* counterclockwise by a non-illustrated driver may cause a top sheet in the first sheet cassette 31 to go through a sheet feeding path 33. Rotating the second feeding roller 32*a* counterclockwise by a non-illustrated driver may cause a top sheet in the second sheet cassette 32 to go through a sheet feeding path 33. Two or more conveyance rollers 34 are provided along the sheet feeding path 33. The recording sheet P may be conveyed upward with the conveyance rollers 34 along the sheet feeding path 33.

A registration roller pair 35 is provided at the end of the sheet feeding path 33. The registration roller pair 35 may stop once its rotation soon after the sheet P is conveyed into the registration roller pair 35. Then, the sheet P may be sent out to the below-mentioned secondary transfer nip at a given timing.

A transfer unit 40 is provided above the process units 1Y, 1C, 1M, and 1K, which may drive an intermediate transfer belt 41 to rotate counterclockwise. The transfer unit 40 includes a belt cleaning unit 42, a first bracket 43, a second bracket 44, etc. besides the intermediate transfer belt 41. The transfer unit 40 further includes four first transfer rollers 45Y, 45C, 45M, and 45K, a second transfer backup roller 46, a driving roller 47, an auxiliary roller 48, a tension roller 49, etc.

The intermediate transfer belt 41 may be tensed by these eight rollers and rotated with the driving roller 47 counterclockwise. The intermediate transfer belt 41 may form four first transfer nips between each of four first transfer rollers 45Y, 45C, 45M, and 45K and four photoconductors 3Y, 3C, 3M, and 3K, respectively. A transfer bias of reverse polarity of toner (for example, a plus) is applied to a back side (an inside of a loop) of the intermediate transfer belt 41. The toner images on the photoconductors 3Y, 3C, 3M, and 3K may be firstly transferred onto a surface of the intermediate transfer belt 41 in the four first transfer nips. Then, a four color toner image may be formed on the intermediate transfer belt 41.

The intermediate transfer belt 41 may another form a second transfer nip between the second transfer backup roller 46 and a second transfer roller 50. A registration roller pair 35 may send the recording sheet P into the second transfer nip at the timing of synchronizing with the four color toner image on the intermediate transfer belt 41. The toner image on the intermediate transfer belt 41 may be transferred onto the sheet P in a second transfer electric field in the second transfer nip with a second transfer bias to the second transfer roller 50 and an effect of a nip pressure. A four color toner image may be formed on the sheet P which may have a white color as a background.

A waste toner may be remained on the intermediate transfer belt 41 after the second transfer. The waste toner may be cleaned with the belt cleaning unit 42. The belt cleaning unit 42 may have a cleaning blade 42*a* in contact with a surface of the intermediate transfer belt 41 to remove the waste toner on the intermediate transfer belt 41.

The first bracket 43 may rotate by a given angle with a non-illustrated solenoid wherein a center of the auxiliary roller 48 as a center of the rotation. When this printer forms a monochrome image, only a little counterclockwise rotation of the first bracket 43 may be made with the drive of the above-mentioned solenoid. This rotation may cause an out of touch between the intermediate transfer belt 41 and the three photoconductors 3Y, 3C, and 3M. Only the process unit 1K may be driven to form a black and white image. This may reduce a wasting consumption of the process units 1Y, 1C, and 1M.

An image fixing unit 60 is provided above the second transfer nip. This fixing unit 60 includes a heating roller 61 having a source of heat generation such as a halogen lamp, and a fixing belt unit 62. The fixing belt unit 62 includes a heating roller 63 having a source of heat generation such as a halogen lamp, a fixing belt 64, a tension roller 65, a driving roller 66, a non-illustrated temperature sensor, etc. The endless fixing belt 64 may be tensed with the heating roller 63, the tension roller 65, and the driving roller 66 and may be rotated counterclockwise. The fixing belt 64 may be heated from a back side with the heating roller 63. An image fixing nip may be formed between the heating roller 61 and the fixing belt 64.

The non-illustrated temperature sensor may be provided keeping a given gap with a surface of the fixing belt 64, so that it may detect surface temperature of the fixing belt 64 prior into the fixing nip. The detecting result may be sent to a non-illustrated a power source of the image fixing unit 60. The power source of the image fixing unit 60 may control the heat generation in the heating roller 63 and the heating roller 61 by on/off control according to the detecting result of the temperature sensor. This may keep a temperature of, for example, 140 degrees C. on the surface of the fixing belt 64.

The sheet P passed through the second transfer nip may be separated from the intermediate transfer belt 41 and may be sent into the image fixing unit 60. The toner image on the sheet P may be fixed on the sheet P by heating and pressing in the fixing nip in the image fixing unit 60.

The sheet P after fixing may be ejected with an ejecting roller pair 67. The ejected sheet P may be stacked on a stack area 68.

Four toner cartridges 100Y, 100C, 100M, and 100K are provided above the transfer unit 40, which include toner of Y, C, M, and K, respectively. These toner of Y, C, M, and K may be supplied to development units 7Y, 7C, 7M, and 7K of the process units 1Y, 1C, 1M, and 1K, respectively. These toner cartridges 100Y, 100C, 100M, and 100K may be detachable.

Figure 5:
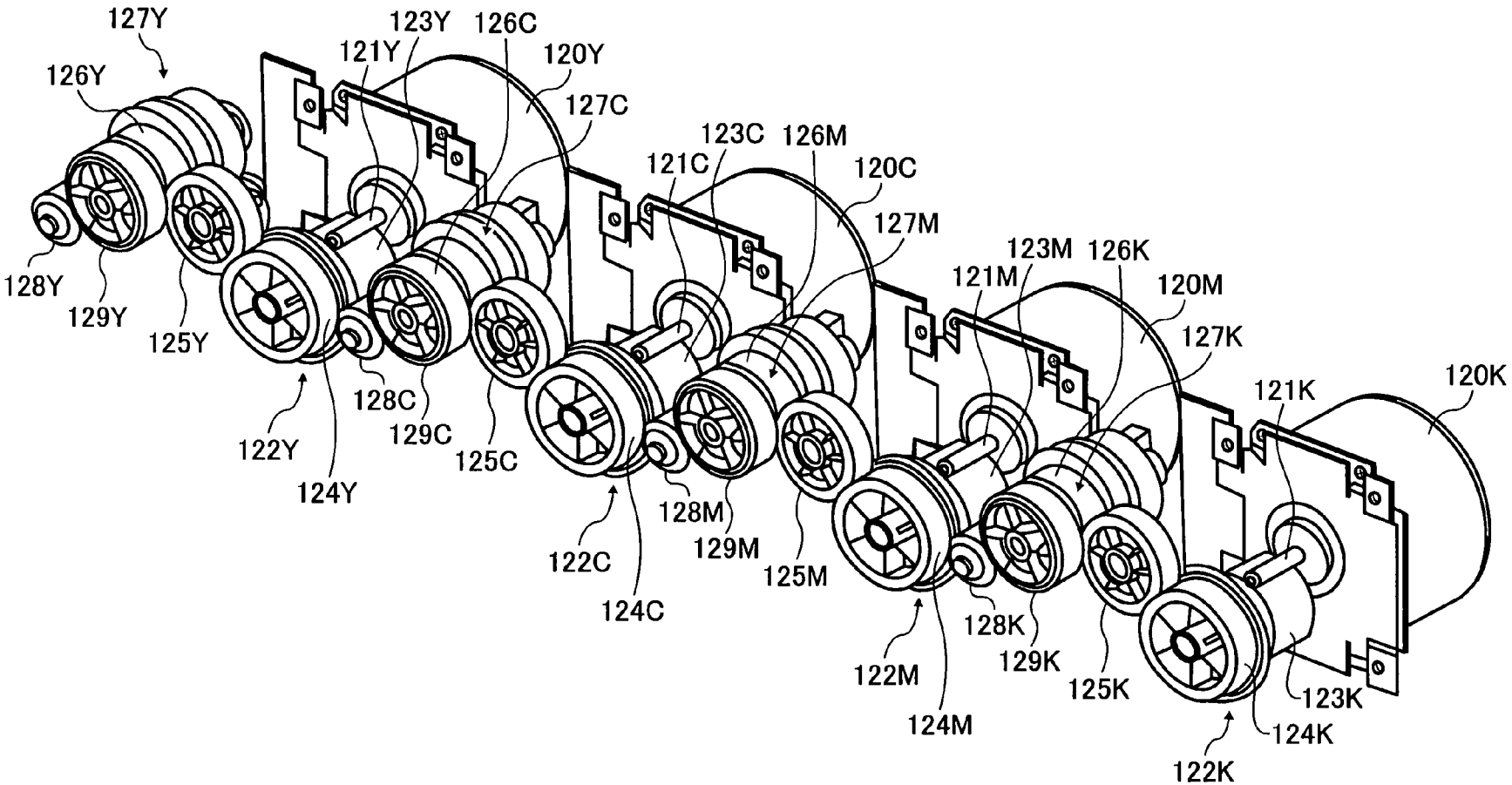
FIG. 5 is a perspective diagram (according to an example embodiment of the present invention) illustrating a driving unit of the image forming apparatus of FIG. 1.
Figure 6:
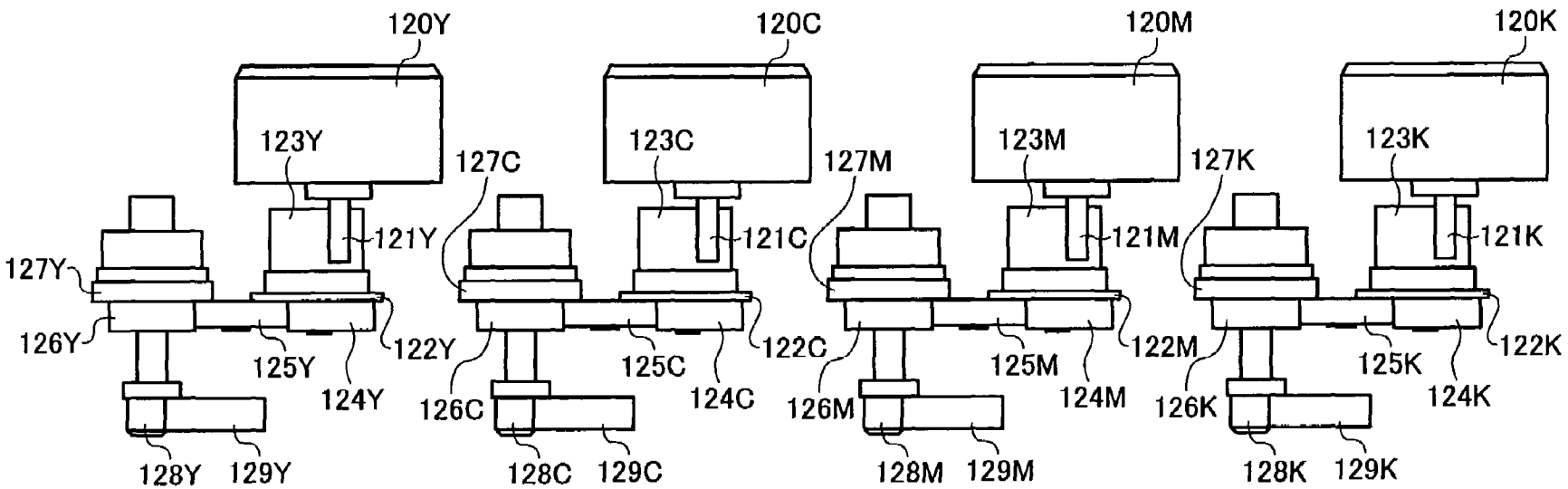
FIG. 6 is a top view (according to an example embodiment of the present invention) illustrating the driving unit of FIG. 5.

FIG. 5 is a perspective diagram illustrating a driving unit of the image forming apparatus of FIG. 1. FIG. 6 is a top view illustrating the driving unit of FIG. 5. As shown in FIG. 5, four process motors 120Y, 120C, 120M, and 120K are fixed on a vertical board to drive the image bearers in the printer. Driving gears 121Y, 121C, 121M, and 121K are fixed on shafts of the driving motors 120Y, 120C, 120M, and 120K, respectively. Developing gears 122Y, 122C, 122M, and 122K are provided under the shafts of the driving motors 120Y, 120C, 120M, and 120K, respectively. These developing gears 122Y, 122C, 122M, and 122K include first gear parts 123Y, 123C, 123M, and 123K and second gear parts 124Y, 124C, 124M, and 124K on nearly same rotation axis, respectively. DC servomotors may be used as the driving motors 120Y, 120C, 120M, and 120K.

First relay gears 125Y, 125C, 125M, and 125K are provided left side of the developing gears 122Y, 122C, 122M, and 122K, respectively. These first relay gears 125Y, 125C, 125M, and 125K may engage the second gear parts 124Y, 124C, 124M, and 124K, respectively, so that the first relay gears 125Y, 125C, 125M, and 125K may be rotated with the developing gears 122Y, 122C, 122M, and 122K, respectively. These first relay gears 125Y, 125C, 125M, and 125K may further engage clutch input gears 126Y, 126C, 126M, and 126K, respectively. These clutch input gears 126Y, 126C, 126M, and 126K may be supported with development clutches 127Y, 127C, 127M, and 127K, respectively.

The development clutches 127Y, 127C, 127M, and 127K may be controlled with a non-illustrated controller so that the clutch input gears 126Y, 126C, 126M, and 126K may be rotated or not. Clutch output gears 128Y, 128C, 128M, and 128K are provided at the end of a shaft of the development clutches 127Y, 127C, 127M, and 127K, respectively. The rotation of the clutch output gears 128Y, 128C, 128M, and 128K may also controlled with the development clutches 127Y, 127C, 127M, and 127K, respectively.

Second relay gears 129Y, 129C, 129M, and 129K are provided left side of the clutch output gears 128Y, 128C, 128M, and 128K, respectively. These second relay gears 129Y, 129C, 129M, and 129K may engage the clutch output gears 128Y, 128C, 128M, and 128K, respectively, so that the second relay gears 129Y, 129C, 129M, and 129K may be rotated.

Figure 7:
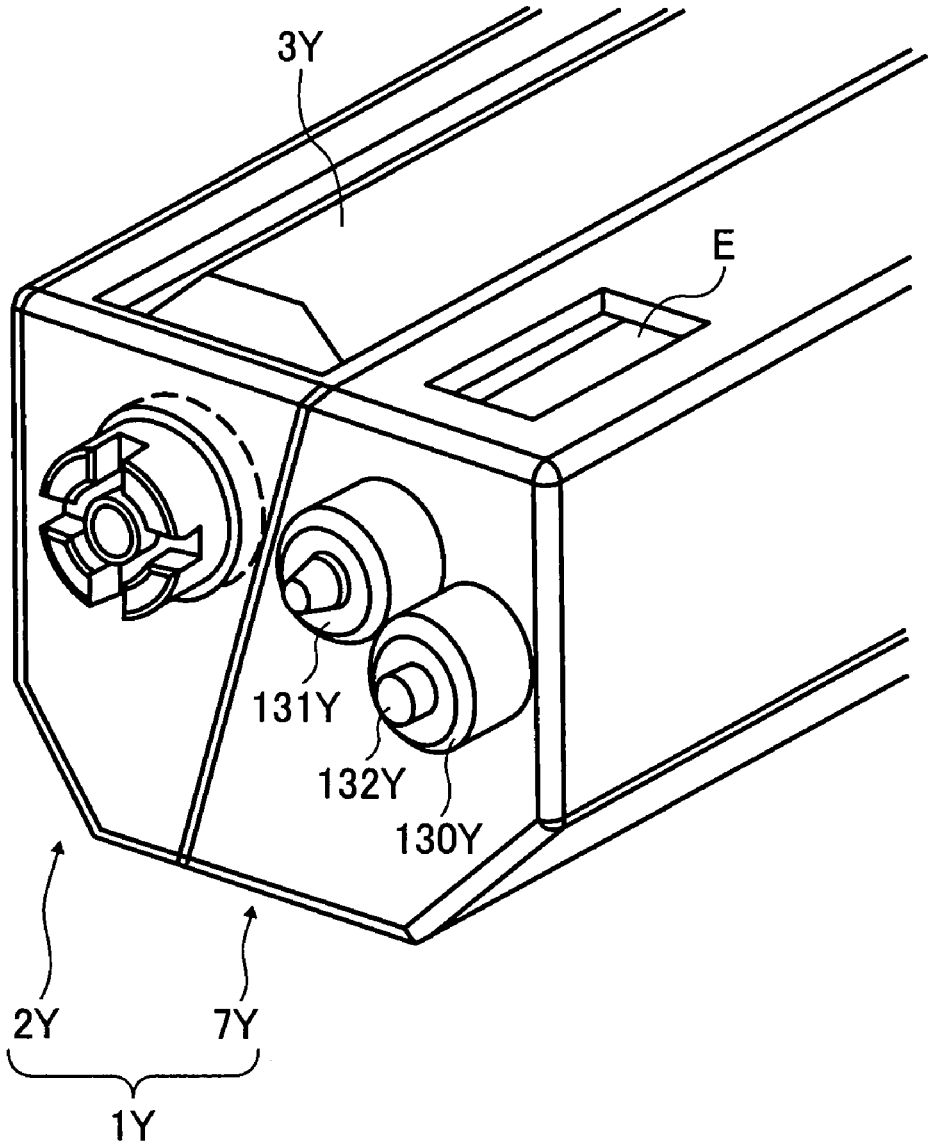
FIG. 7 is a perspective diagram (according to an example embodiment of the present invention) illustrating a one side of a process unit of the image forming apparatus of FIG. 1.

FIG. 7 is a perspective diagram illustrating a one side of the process unit 1Y of the image forming apparatus of FIG. 1. An end of a shaft of the development sleeve 15Y of the developing unit 7Y may be out of the process unit 1Y through its casing. A sleeve upstream gear 131Y is fixed to the shaft as shown in FIG. 7. A fixed axis 132Y is formed on the casing side. A third relay gear 130Y may engage the sleeve upstream gear 131Y, which may be able to rotate.

Where the process unit 1Y is set to the printer, the third relay gear 130Y may engage the sleeve upstream gear 131Y and the second relay gear 129Y previously shown in FIG. 5 and FIG. 6. The driving power of rotation of the second relay gear 129Y may be transmitted to the third relay gear 130Y and the sleeve upstream gear 131Y, and the development sleeve 13Y may be rotated.

Although only process unit 1Y was explained, but in the other color process units, the driving power of rotation may be similarly transmitted to the development sleeves.

As shown in FIG. 7, only one end of the shaft of the development sleeve 15Y is illustrated, the other end may be out of the casing, and a non-illustrated sleeve downstream gear may be fixed on the end. The first conveyance screw 8Y and the second conveyance screw 11Y shown in FIG. 2 may also be out of the casing, and a non-illustrated first screw gear and a second screw gear may be fixed on the ends, respectively. When the development sleeve 15Y is rotated, the sleeve downstream gear may be rotated. The sleeve downstream gear may engage the second screw gear, and the second screw gear may engage the first screw gear, so that the first conveyance screw 8Y and the second conveyance screw 11Y are rotated with the rotation of the sleeve downstream gear.

Like this, the other color process units may have a similar configuration.

Figure 8:
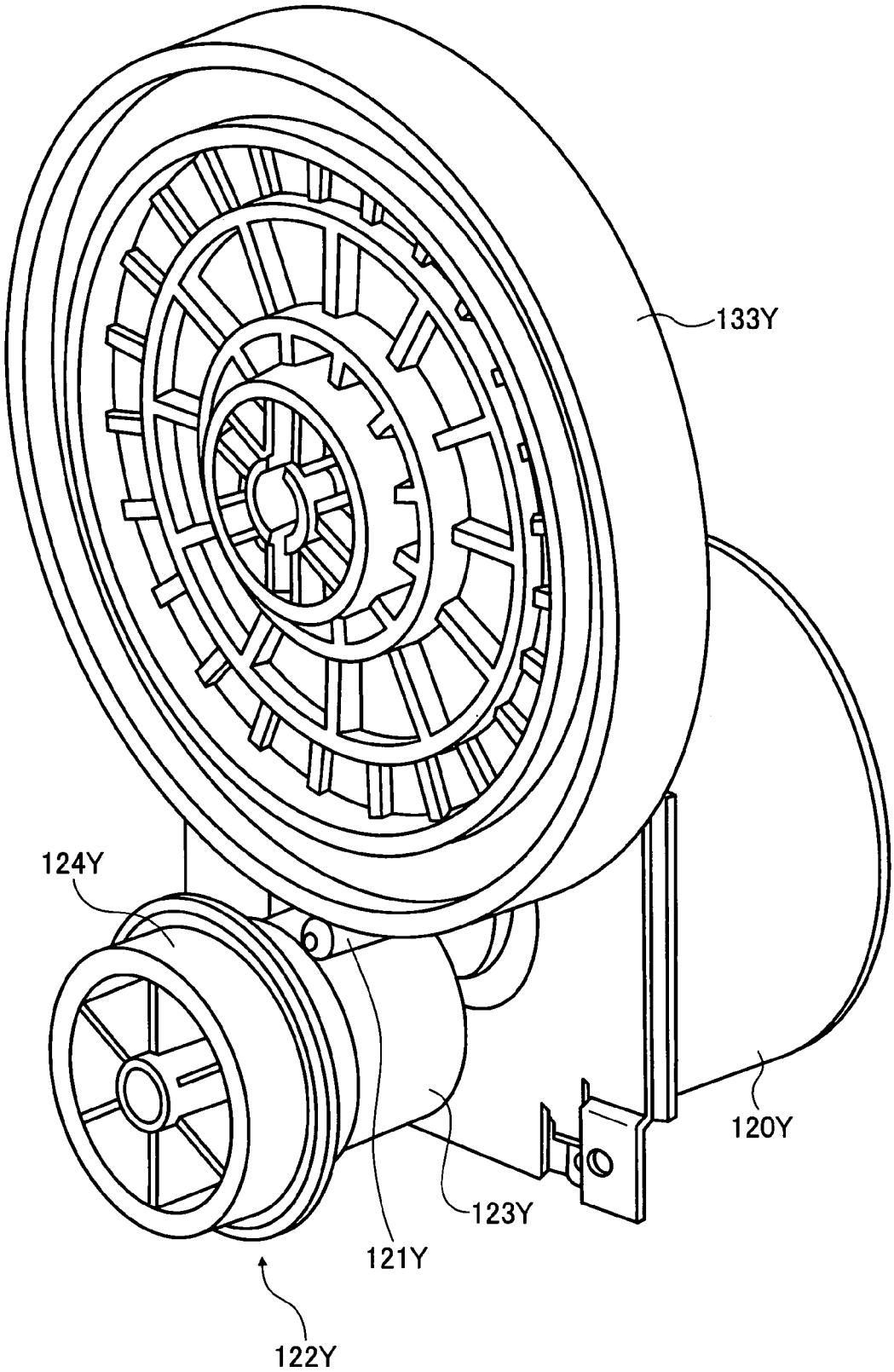
FIG. 8 is a perspective diagram (according to an example embodiment of the present invention) illustrating a photoconductor gear and its vicinity in the image forming apparatus of FIG. 1.

FIG. 8 is a perspective diagram illustrating a photoconductor gear 133Y and its vicinity in the image forming apparatus of FIG. 1. The first gear parts 123Y and the photoconductor gear 133Y may engage the driving gear 121Y. The photoconductor gear 133Y may be connected to a drive transmission part of a main body of the printer. A diameter of the photoconductor gear 133Y may be larger than a diameter of the photoconductor. A rotation of the driving motor 120Y may cause a driving force of the driving gear to transmit to the driving gear 121Y by one-step slowdown of a rotation speed. The processes for other colors may be also carried out in the similar manner.

A shaft of the photoconductor of the process unit and the photoconductor gear 133 supported with a main body of the printer may be connected by a coupling fixed to the end of the shaft of the photoconductor. Two motors may be used for the development gear and the photoconductor gear in each color.

Figure 9:
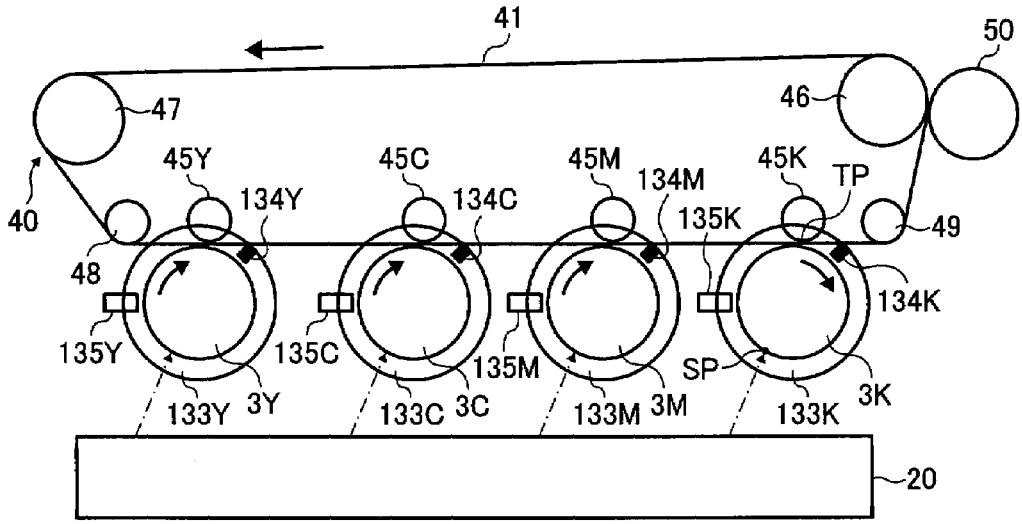
FIG. 9 is a cross-sectional (according to an example embodiment of the present invention) diagram illustrating photoconductors, transfer units, and optical writing units of the image forming apparatus of FIG. 1.

FIG. 9 is a cross-sectional diagram illustrating photoconductors, transfer units, and optical writing units of the image forming apparatus of FIG. 1. Marks 134Y, 134C, 134M, and 134K are given to the sides of the photoconductor gears 133Y, 133C, 133M, and 133K, respectively. In every rotation of the photoconductor gears 133Y, 133C, 133M, and 133K, the marks 134Y, 134C, 134M, and 134K may be detected with position sensors 135Y, 135C, 135M, and 135K, respectively, which may be a photograph sensor etc., in a given timing. Then, a given rotation angle of the photoconductors 3Y, 3C, 3M, and 3K, may be detected in every its rotation.

Figure 10:
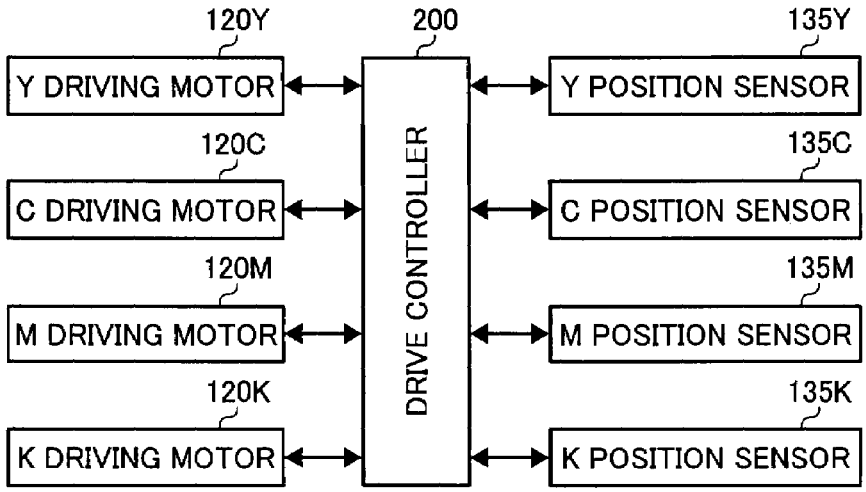
FIG. 10 is a block diagram (according to an example embodiment of the present invention) illustrating a part of an electric circuit of the image forming apparatus of FIG. 1.

FIG. 10 is a block diagram illustrating a part of an electric circuit of the image forming apparatus of FIG. 1. As shown in FIG. 10, a drive controller 200 including non-illustrated CPUs, RAM, ROMs, etc. may function as a drive stopping controller. At the time of a print job end, a drive process of the driving motors 120Y, 120C, 120M and 120K may be stopped based on the detection result with the position sensors 135Y, 135C, 135M and 135K. Thus, rotation of the four photoconductors 3Y, 3C, 3M, and 3K may be stopped.

The drive controller 200 may start measure timing from the detection of the marks 134Y, 134C, 134M, and 134K. The drive controller 200 may stop the driving motors 120Y, 120C, 120M and 120K at a given timing. Then, a stop position of the rotation of the four photoconductors 3Y, 3C, 3M, and 3K may be controlled.

Figure 11:
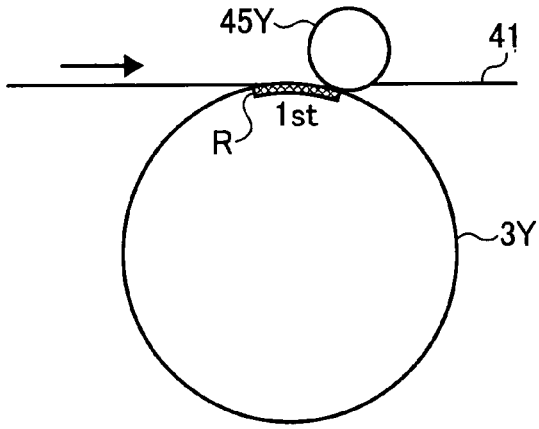
FIG. 11 is a cross-sectional diagram (according to an example embodiment of the present invention) illustrating a nip of the photoconductor at first driving stop timing of the image forming apparatus of FIG. 1.
Figure 12:
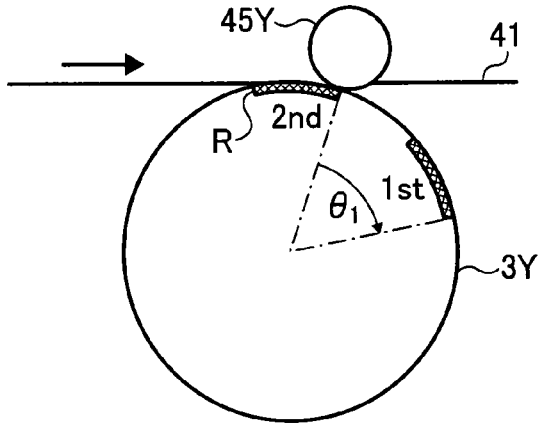
FIG. 12 is a cross-sectional diagram (according to an example embodiment of the present invention) illustrating nips of the photoconductor at first and second driving stop timings of the image forming apparatus of FIG. 1.
Figure 13:
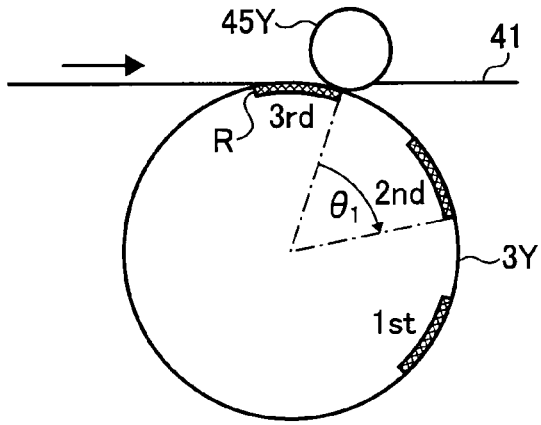
FIG. 13 is a cross-sectional diagram (according to an example embodiment of the present invention) illustrating nips of the photoconductor at first, second, and third driving stop timings of the image forming apparatus of FIG. 1.

FIG. 11 is a cross-sectional diagram illustrating a nip of the photoconductor at first driving stop timing of the image forming apparatus of FIG. 1. FIG. 12 is a cross-sectional diagram illustrating nips of the photoconductor at first and second driving stop timings of the image forming apparatus of FIG. 1. FIG. 13 is a cross-sectional diagram illustrating nips of the photoconductor at first, second, and third driving stop timings of the image forming apparatus of FIG. 1. The drive controller 200 may stop the four photoconductors 3Y, 3C, 3M, and 3K with a given angle of $\theta_1$ shifted from a starting position. As shown in FIGS. 11, 12, and 13, the photoconductor 3Y may stop with a nip R with shifted $\theta_1$ in every its driving stop.

Figure 14:
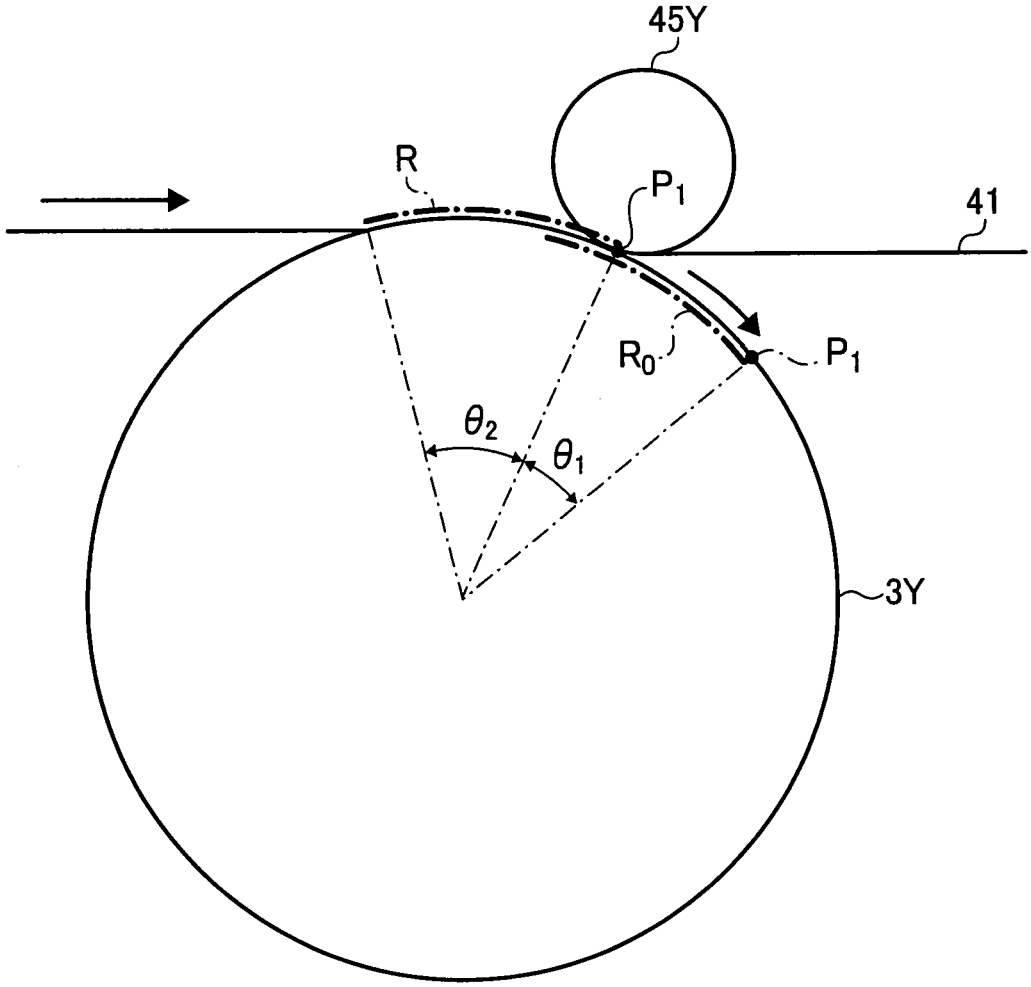
FIG. 14 is a cross-sectional diagram (according to an example embodiment of the present invention) illustrating a nip of the photoconductor of the image forming apparatus of FIG. 1.
Figure 15:
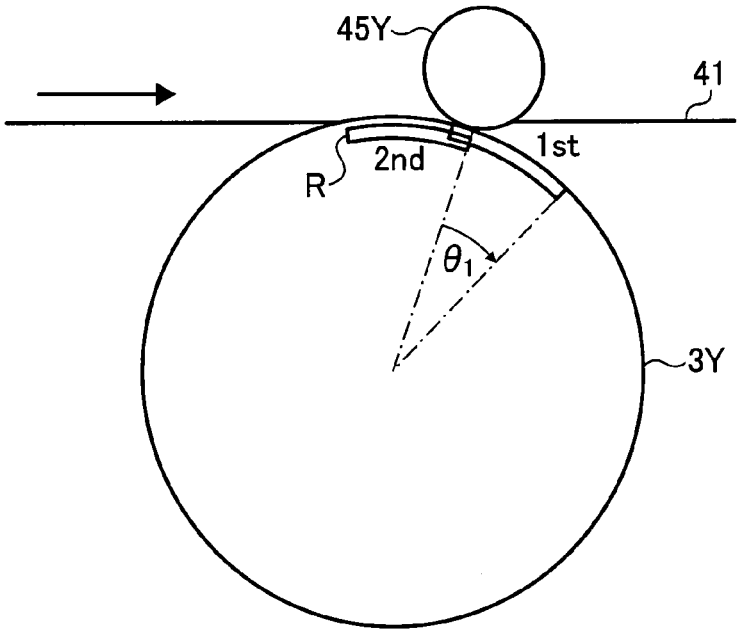
FIG. 15 is a cross-sectional diagram (according to an example embodiment of the present invention) illustrating nips of the photoconductor at first and second driving stop timings of the image forming apparatus of FIG. 1.
Figure 16:
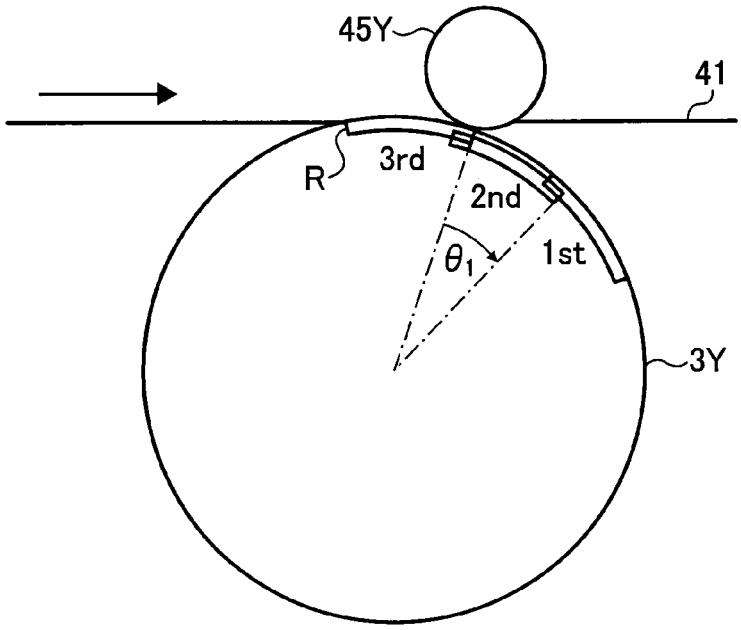
FIG. 16 is a cross-sectional diagram (according to an example embodiment of the present invention) illustrating nips of the photoconductor at first, second, and third driving stop timings of the image forming apparatus of FIG. 1.

FIG. 14 is a cross-sectional diagram illustrating a nip of the photoconductor of the image forming apparatus of FIG. 1. FIG. 15 is a cross-sectional diagram illustrating nips of the photoconductor at first and second driving stop timings of the image forming apparatus of FIG. 1. FIG. 16 is a cross-sectional diagram illustrating nips of the photoconductor at first, second, and third driving stop timings of the image forming apparatus of FIG. 1. Although controlling a driving stop, as shown in FIG. 14, when the rotation shift angle $\theta_1$ is smaller than a nip angle $\theta_2$, an end of a stopped nip R0 at a prior driving stop may be inside a nip of a driving stop of this time. As shown in FIGS. 15 and 16, certain places of a surface of the photoconductor 3Y may successively be worn during two times of driving stops. This may decrease a life of the photoconductor 3Y. A belt member like the intermediate transfer belt 41, may be especially easy to cause wearing with the photoconductor, because the surface migration speed at the time of a stop may become unstable compared with a cylindrical thing like a charge roller.

Figure 17:
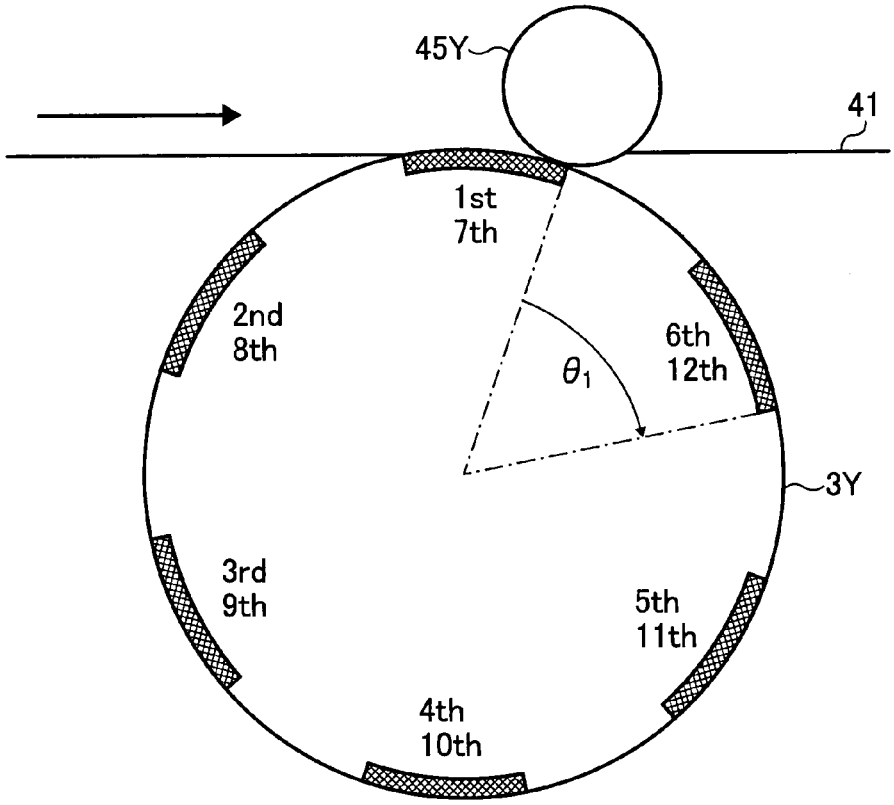
FIG. 17 is a cross-sectional diagram (according to an example embodiment of the present invention) illustrating nips of the photoconductor at first through twelfth driving stop timings of the image forming apparatus of FIG. 1.

FIG. 17 is a cross-sectional diagram illustrating nips of the photoconductor at first through twelfth driving stop timings of the image forming apparatus of FIG. 1. Conditions A in which the rotation shift angle $\theta_1$ is larger than a nip angle $\theta_2$ may be provided to the printer. This may reduce an occasion that certain places of the surface of the photoconductor 3Y may successively be worn during driving stops and may increase a life of the photoconductor 3Y.

However, conditions A may be still inadequate. This is based on the reason for explaining below. Pressure in the first transfer nip may not be even in this printer. In the first transfer nip, the first transfer roller 45Y may increase the pressure by pressing against a back side of the belt. A strong wear may occur in such region. When the rotation shift angle $\theta_1$ is set to 60 degrees, a nip of this stop of driving and 6 times before may be almost the same, because 60 degrees times 6 is one rotation. As shown in FIG. 17, when a nip of first stop of driving and that of seventh stop of driving is almost the same, a strong wear due to successive strong pressure may occur.

Conditions B in which the rotation shift angle $\theta_1$ that is an integer and is not a divisional angle of 360 degrees with the conditions A may be provided to the printer. A stop position of the photoconductor may be shifted by an angle of $\theta_1$ in every stop of driving and may not become a same position according to the conditions B. Therefore, a same position of the photoconductor in the first transfer nip may not be worn successively. This may decrease a deterioration of the photoconductor.

Figure 18:
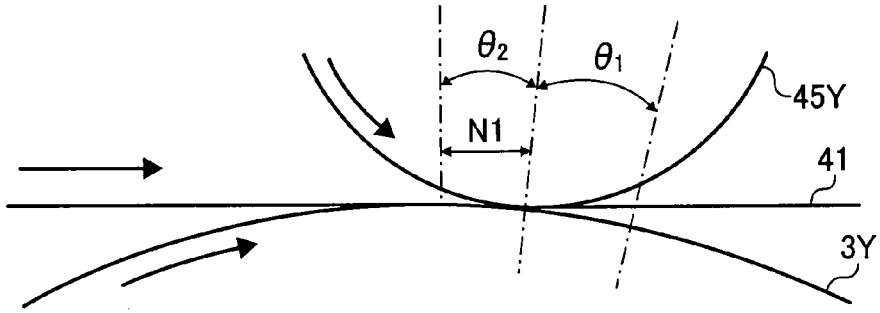
FIG. 18 is a cross-sectional diagram (according to an example embodiment of the present invention) illustrating a nip of the photoconductor of the image forming apparatus of FIG. 1.

FIG. 18 is a cross-sectional diagram illustrating a nip of the photoconductor of the image forming apparatus of FIG. 1. Conditions C in which the rotation shift angle $\theta_1$ has a small different angle with a nip angle $\theta_2$ with the conditions A and B may be provided to the printer. For example, as shown in FIG. 18, a belt and the photoconductor may contact by a width N1 of 2 mm. A radius r of the photoconductor 3Y, 3C, 3M, and 3K may be 20 mm. A peripheral length of the photoconductor 3Y, 3C, 3M, and 3K may be 125.6 mm. This peripheral length may be 62.8 times N1. The nip angle $\theta_2$ may be about 5.7 degrees which is a 360/62.8 degrees. A larger integer than 5.7 is 6, but it is a divisional number of 360. Then, 7 degrees may be set as the rotation shift angle $\theta_1$.

The conditions A and B may make a void area on the surface of the photoconductor between a precede nip of the driving stop and a following nip of the driving stop. If this void area is large, the photoconductor 3Y, 3C, 3M, and 3K may largely be worn. Because a repeat number of wearing same place may be increased. If the void area is smaller than the nip, a part of the nip may be inside the nip of the next driving stop. Therefore, control of the void area may be important. Thus, the conditions A, B, and C may be provided to the printer.

Although transferring a toner image to the intermediate transfer belt from each photoconductor was explained, a system in which a toner image is directly transferred to a recording medium may be used.

Next, another example embodiment of this printer is explained.

In the above-mentioned example embodiment, as shown in FIG. 2, the charge roller 6Y may contact the photoconductor to form a charging nip.

A deterioration by a nitrogen oxide ($NO_x$) generated with electric discharge between electrification components, such as a charge roller, may occur besides the deterioration by wearing of a photoconductor in the nip at the time of a driving stop. A nitrogen oxide concentration in the electrification component circumference may increase with running of a print job. When the running of the print job (electric discharge) stops, the increase of $NO_x$ may stop. The $NO_x$ may further diffuse out of the printer, then, the $NO_x$ concentration may decrease. But, for a while, the $NO_x$ concentration may keep high value after the print job stop. Therefore, the photoconductor near the charge nip may deteriorate by the $NO_x$.

An experiment has been carried out, and the results show that the deterioration by the $NO_x$ may be larger than by the wearing. The rotation shift angle $\theta_1$ may be set not according to the first transfer nip but according to the charge nip. For example, The rotation shift angle $\theta_1$ may be set according to the charge nip with the conditions A and B. Therefore, the deterioration by the $NO_x$ may be decreased at the time of driving stop.

Only providing the two conditions may not well control the deterioration of the photoconductor by the $NO_x$ at the time of driving stop. The deterioration may be promoted depending on the case. This is based on the reason for explaining below. The conditions C is desirable on the matter of wearing. But the moving distance of the photoconductor may be small at every stop of the driving. For example, in the case where a radius of the photoconductor is 20 mm, the rotation shift angle $\theta_1$ is 7 degrees may result in the moving distance of the photoconductor is as small as 2.4 mm at every stop of the driving. Even the small distance may be longer the nip width 2 mm. This may not cause two successive wearing in the same nip, so that the life of the photoconductor may be prolonged. But only the distance of 2.4 mm may not well prevent a region of a high concentration of the $NO_x$. Therefore, the deterioration of the photoconductor may be progressed by this reason.

Then, another condition is considered. Conditions D in which the rotation shift angle $\theta_1$ that is an integer larger than a minimum integer as difference from the nip angle $\theta_2$ and is not a divisional angle of 360 degrees with the conditions A and B may be provided to the printer. For example, when a width of a charging nip is 2 mm with the conditions A and B result that the minimum integer as different from the nip angle $\theta_2$ is 7. The conditions D may set the larger integer, but 8, 9, and 10 do not meet the conditions B. So 11 or one of the larger integer may be set as the number with the conditions A and B. In the configuration, the deterioration of the photoconductor by $NO_x$ may be reduced more than with the conditions C.

Furthermore, Conditions E in which the rotation shift angle $\theta_1$ that is a nearest integer with 180 and is not a divisional angle of 360 degrees with the conditions A, B, and D may be provided to the printer. In the configuration, the deterioration of the photoconductor by $NO_x$ may be reduced more than with the conditions D because a previous driving stop nip may farther be stopped from a region of a high concentration of the $NO_x$ at every stop of driving.

In another example embodiment, the charge roller 6Y may not contact the photoconductor and may have a given gap with the photoconductor for charging. In the configuration, the charge roller may not cause the wearing, so the rotation shift angle $\theta_1$ according to the first transfer nip angle $\theta_2$ may be provided to the printer.

Although the charge roller may not contact the photoconductor, the $NO_x$ may be generated due to electric discharge in the gap. Therefore, the conditions D in which the rotation shift angle $\theta_1$ that is an integer larger than a minimum integer as difference from the nip angle $\theta_2$ and is not a divisional angle of 360 degrees may be provided to the printer. For example, in the case where a first transfer nip width is 2 mm, a radius R of the photoconductor is 20 mm, and a nip angle $\theta_2$ is 5.7 degrees, 109 degrees may be adopted as larger integer than 7 meeting the conditions A, B, and D.

Figure 19:
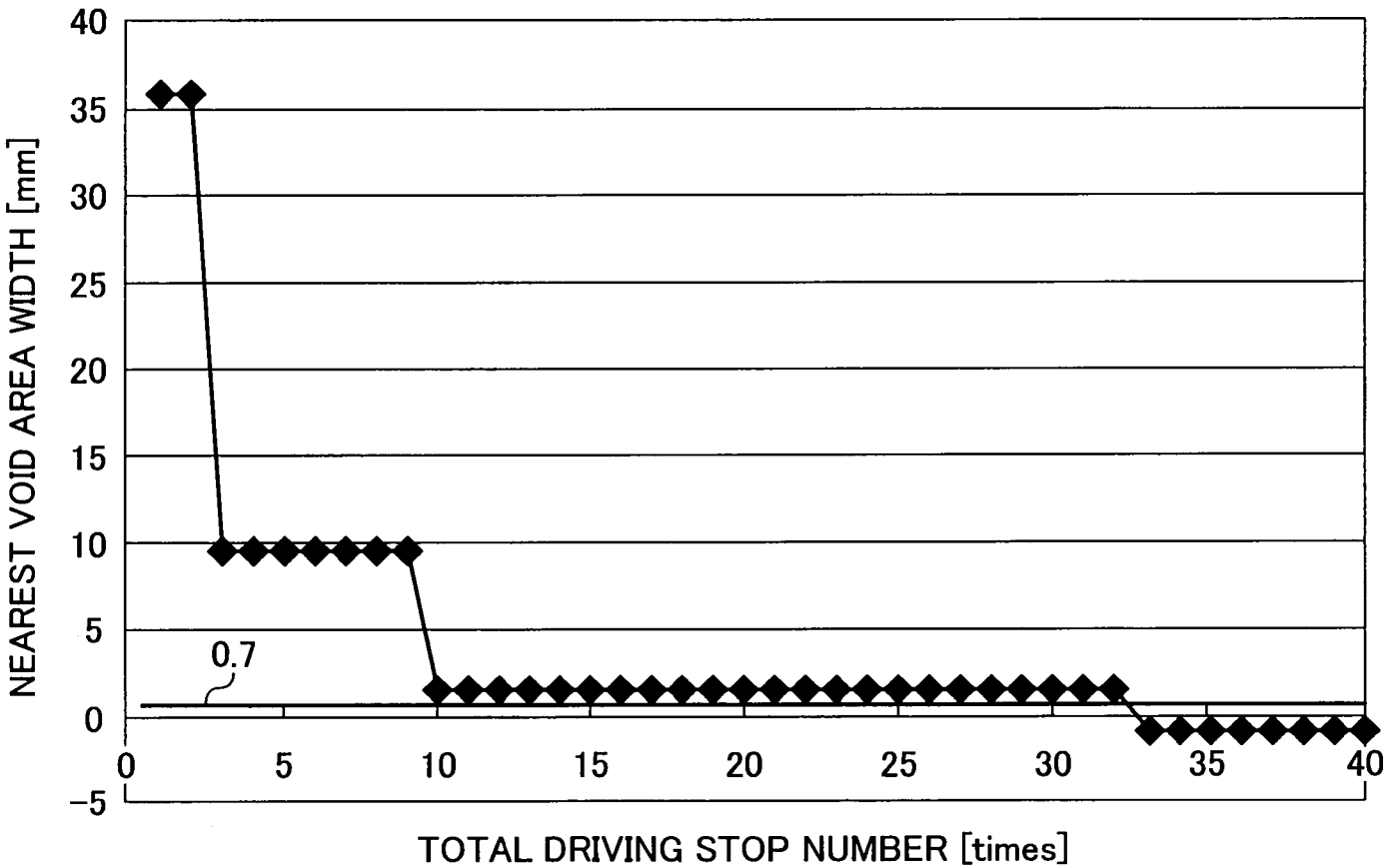
FIG. 19 is a graph (according to an example embodiment of the present invention) illustrating a relation between a total number of driving stops and a width of the nearest void area on the photoconductor of another example of the image forming apparatus of FIG. 1.

FIG. 19 is a graph illustrating a relation between a total number of driving stops and a width of the nearest void area on the photoconductor of the printer. Using the rotation shift angle $\theta_1$ as mentioned above, as shown in FIG. 19, the width of the nearest void area may be 36 mm after two times of driving stops. The nearest void area means the nearest gap between a past nip of driving stop and a present nip of driving stop. The width of the nearest void area may be about 9 mm at the time of third driving stop. The width of the nearest void area may be reduced to about 0.8 mm after 10 times of driving stops.

Figure 20:
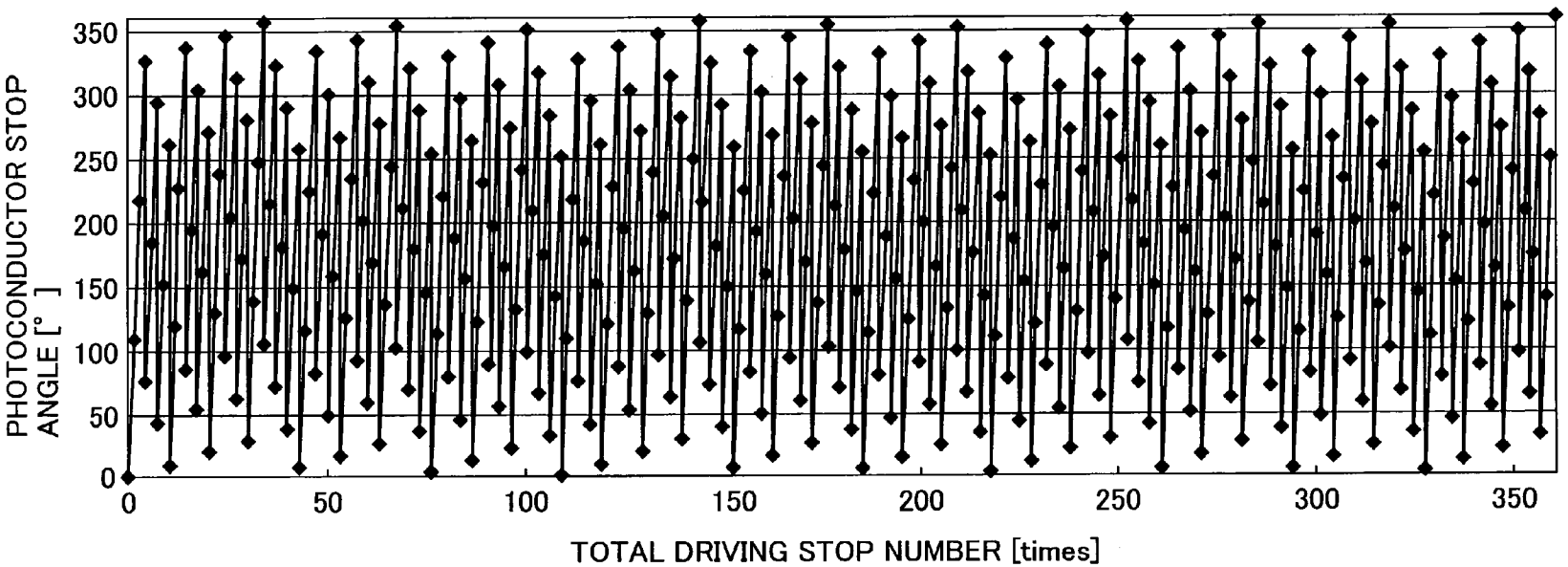
FIG. 20 is a graph (according to an example embodiment of the present invention) illustrating a relation between a total number of driving stops and an angle of a photoconductor stop of another example of the image forming apparatus of FIG. 1.

FIG. 20 is a graph illustrating a relation between a total number of driving stops and an angle of a photoconductor stop. As shown in FIG. 20, the plotting point means a rotation angle from a reference position in a nip of driving stop. As shown in FIG. 20, the nip of driving stops may be well distributed in a circumference of the photoconductor.

In the configuration, the charge roller may not cause the wearing to reduce the deterioration of the photoconductor at the time of driving stop.

In the configuration, the intermediate transfer belt which forms the first transfer nip for transferring a visible image from the photoconductor onto the recording medium P which is in contact with the intermediate transfer belt. This configuration may reduce the deterioration of the photoconductor by wearing in the first transfer nip at the time of driving stop.

When using a one component development apparatus, a developing roller which develops a latent image on the photoconductor by using toner carried on its surface may be provided. In this case, the deterioration of the photoconductor by wearing in the developing nip at the time of driving stop may be reduced.

In the configuration with the conditions A, B, and C, repeated wearing of the photoconductor may be reduced in the restrictions of the conditions A and B.

In the configuration with the conditions A, B, and D, the deterioration of the photoconductor by $NO_x$ may be reduced more than with the conditions C.

In the configuration with the conditions A, B, D, and E, the deterioration of the photoconductor by $NO_x$ may be reduced in the restrictions of the conditions A and B.

When the charge roller is not contact with the photoconductor, the photoconductor may evenly be charged without the deterioration of the photoconductor by wearing.

In the configuration with the conditions A, B, and D, the deterioration of the photoconductor by $NO_x$ and by wearing in the first transfer nip may be reduced This invention is not limited to the above-mentioned examples. It is clear that the form of each above-mentioned example may be suitably changed within the limits of this invention. The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention. Also, the number of components, a position, form, etc. are not limited to the form of each above-mentioned example, when carrying out embodiments of this invention, they may have a suitable number, a position, form, etc.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. JPAP2006-052501 filed on Feb. 28, 2006 in the Japan Patent Office, the entire contents of which are incorporated by reference herein.

What is claimed is:

1. An image forming apparatus to form an image on a recording medium, comprising:

an image bearer;

a driver to move the image bearer;

an image forming device to form a visible image on a surface of the image bearer;

a contacting member to form a nip by contacting with the image bearer; and a controller to control the driver to stop the image bearer at a position different from a last stop position by a distance, the distance being greater than a width of the nip and not a divisor of a peripheral length of the image bearer.

2. The image forming apparatus of claim 1, wherein the image bearer includes a cylindrical shape and wherein the distance satisfies a condition A in which a rotation shift angle formed by the present stop position and the last stop position is larger than an angle of the nip, and satisfies a condition B in which the rotation shift angle is an integer and is not a divisor of 360.

3. The image forming apparatus of claim 2, further comprising:

a non-contacting charge member to charge the surface of the image bearer with a gap therebetween, wherein the contacting member is a transfer member to transfer the visible image from the image bearer onto a recording medium at a transfer nip between the transfer member and the image bearer, and wherein the image bearer is controlled with a condition where the number of the rotation shift angle is greater than that of condition C under the conditions A and B.

4. The image forming apparatus of claim 2, wherein the image bearer may be controlled with a condition C in which the number of the rotation shift angle $\theta_1$ is a minimum integer under the conditions A and B.

5. The image forming apparatus of claim 4, wherein the contacting member is a charge member to charge the surface of the image bearer at a charge nip between the charge member and the image bearer, and wherein the image bearer is controlled with a condition D in which the rotation shift angle is an integer greater than an integer in a condition C under the conditions A and B.

6. The image forming apparatus of claim 5, wherein the image bearer is controlled with a condition E in which the number of the rotation shift angle is an integer nearest to 180 under the conditions A, B, and D.

7. The image forming apparatus of claim 1, wherein the contacting member is a transfer member to transfer the visible image from the image bearer onto a recording medium at a transfer nip between the transfer member and the image bearer.

8. The image forming apparatus of claim 7, further comprising:

a non-contacting charge member to charge the surface of the image bearer with a gap therebetween.

9. The image forming apparatus of claim 1, wherein the contacting member is a charge member to charge the surface of the image bearer at a charge nip between the charge member and the image bearer.

10. The image forming apparatus of claim 1, wherein the contacting member is a developing member to develop a latent image on the image bearer using a developer in a developing nip between the contacting member and the image bearer to form the visible image.

11. An image forming apparatus to form an image on a recording medium, comprising:

means for moving an image bearer;

means for forming a visible image on a surface of the image bearer;

means for forming a nip by contacting with the image bearer; and means for controlling the means for moving to stop the image bearer at a position different from a last stop position by a distance, the distance being greater than a width of the nip and not a divisor of a peripheral length of the image bearer.

12. The image forming apparatus of claim 11, wherein the image bearer includes a cylindrical shape and wherein the distance satisfies a condition A in which a rotation shift angle formed by the present stop position and the last stop position is larger than an angle of the nip, and satisfies a condition B in which the rotation shift angle is an integer and is not a divisor of 360.

13. The image forming apparatus of claim 12, further comprising:

means for charging the surface of the image bearer with a gap therebetween, wherein the means for forming a nip includes means for transferring the visible image from the image bearer onto a recording medium at a transfer nip between the means for transferring and the image bearer, and wherein the image bearer is controlled with a condition where the number of the rotation shift angle is greater than that of condition C under the conditions A and B.

14. The image forming apparatus of claim 12, wherein the image bearer is controlled with a condition C in which the number of the rotation shift angle is a minimum integer under the conditions A and B.

15. The image forming apparatus of claim 14, wherein the means for forming a nip includes a charge member to charge the surface of the image bearer at a charge nip between the charge member and the image bearer, and wherein the image bearer is controlled with a condition D in which the rotation shift angle is an integer greater than an integer in a condition C under the conditions A and B.

16. The image forming apparatus of claim 15, wherein the image bearer is controlled with a condition E in which the number of the rotation shift angle is an integer nearest to 180 under the conditions A, B, and D.

17. The image forming apparatus of claim 11, wherein the means for forming a nip includes means for transferring the visible image from the image bearer onto a recording medium at a transfer nip between the means for transferring and the image bearer.

18. The image forming apparatus of claim 17, further comprising:

means for charging the surface of the image bearer with a gap therebetween.

19. The image forming apparatus of claim 11, wherein the means for forming a nip includes means for charging the surface of the image bearer at a charge nip between the means for charging and the image bearer.

20. The image forming apparatus of claim 11, wherein the means for forming a nip includes means for developing a latent image on the image bearer using a developer in a developing nip between the means for forming a nip and the image bearer to form the visible image.

* * * * *